United States Patent [19]

Seragnoli

[11] 4,175,456

[45] Nov. 27, 1979

[54] FEEDING AND CUTTING DEVICE FOR SHEET MATERIAL

[75] Inventor: Enzo Seragnoli, Bologna, Italy

[73] Assignee: G. D. Societa per Azioni, Bologna, Italy

[21] Appl. No.: 869,522

[22] Filed: Jan. 16, 1978

[30] Foreign Application Priority Data

Jul. 27, 1977 [IT] Italy ..... 3510 A/77

[51] Int. Cl.[2] ..... B26D 5/22

[52] U.S. Cl. ..... 83/176; 83/253; 83/268

[58] Field of Search ..... 83/253, 176, 251, 254, 83/268

[56] References Cited

U.S. PATENT DOCUMENTS

| | | | |
|---|---|---|---|
| 734,215 | 7/1903 | Bilgram | 83/253 X |
| 979,406 | 12/1910 | Armstrong | 83/251 |
| 2,501,334 | 3/1950 | Hubelmeyer | 83/253 X |
| 2,576,792 | 11/1951 | Johnson | 83/253 |
| 2,725,101 | 11/1955 | Vonttofe | 83/251 |
| 2,985,990 | 5/1961 | Waite et al. | 83/251 X |
| 3,435,717 | 4/1969 | Macomber | 83/268 X |

*Primary Examiner*—J. M. Meister

*Attorney, Agent, or Firm*—H. Dale Palmatier

[57] ABSTRACT

A feeding and cutting device in which a continuous web of sheet material provided with spaced transverse central slits is step advanced by feeding means along a web path to cutting means comprising a movable blade and a stationary blade arranged on opposite sides of said web path on a fixed cutting plane substantially at right angles to said web path, said feeding means advancing the web so that, at the end of each advancing step, one slit is located a short distance downstream from said cutting plane; reciprocating pushing means being operable, at the end of each advancing step, in a direction towards said stationary blade and parallel to said cutting plane to engage the web downstream from said one slit so as to depress the leading edge thereof; and return feeding means being operable, in a direction opposite to said feeding means and before operation of said movable blade, to displace said web backwards until said depressed leading edge engages a lateral downstream edge of said stationary blade.

3 Claims, 4 Drawing Figures

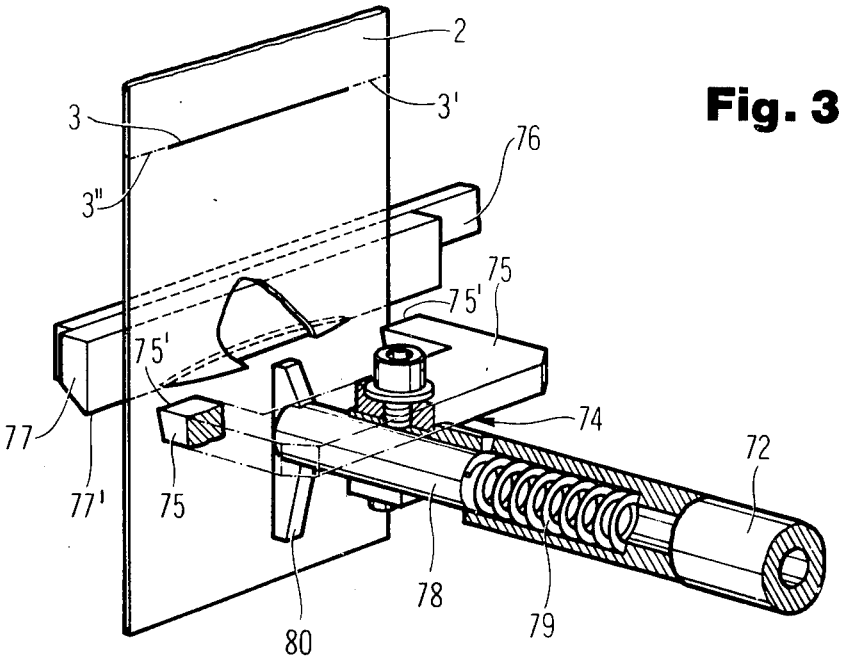
Fig. 3
Fig. 4
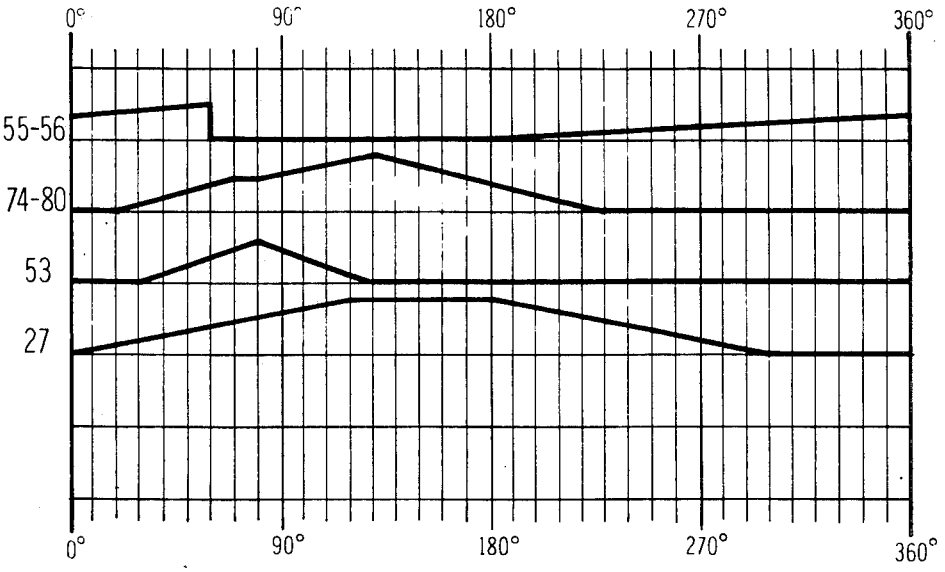

FEEDING AND CUTTING DEVICE FOR SHEET MATERIAL

BACKGROUND OF THE INVENTION

The present invention relates to a feeding and cutting device for sheet material in the form of a continuous web or ribbon to be cut into pieces of substantially equal length, each said piece being defined, on said web, by at least two prearranged transverse cuts or slits provided through a central portion of said web, and which are not long enough to sever the web.

The device of the invention is preferably to be used in combination with a wrapping machine for cigarette packets to provide labels or price and advertising coupons to be inserted between the inner tin-wrap and the outer wrap of individual packets, or to be applied on to the outer wrap of the same as well as of packages, such as cartoons, enclosing a plurality of cigarette packets. However, it is to be pointed out that the device of the invention is particularly suited to be used to provide individual cigarette packets with a respective label or coupon.

The feeding and cutting devices of the prior art, hereinafter referred to as "known devices", generally comprise a web path, along which the web is advanced by advancing means, and cutting means arranged along said path and normally comprising a stationary blade and a movable blade operating scissors-like to sever the web into pieces.

As far as the webs are concerned, it is to be pointed out that they are normally provided, at least on one side, with a series of prints each defining a label or coupon. Owing to unavoidable repetitive errors in the printing process, the spacing of the prints is substantially, but not exactly, constant.

The above made it necessary for the known devices to include registration means adapted to cooperate with reference marks provided on the web between adjacent prints, to register the position of the web along the web path to the cutting means so as to allow the latter to sever the web precisely at the gap or line separating adjacent prints.

U.S. Pat. No. 2,725,101 issued on Nov. 29, 1955 teaches how to provide a web consisting of a series of printed labels, with transverse slits formed through only a portion of the width of the web between adjacent labels; how to advance in a step-by-step manner said web along said web path by means of reciprocating advancing means so designed and arranged that, during each advancing stroke, the web is advanced a distance less than the length of a label; and how to register, at the end of each said advancing stroke, the position of the web so as to arrange a slit thereof on a plane at right angles to said web path and along which the cutting means operate.

The above registration is carried out by means of a registering member which is arranged at a distance upstream from the cutting means and engages the web to depress a central portion thereof arranged immediately upstream from a slit, thus causing the trailing edge of said slit to be depressed without substantially deforming the leading edge thereof.

The registering member is then advanced a predetermined length to engage said leading edge and to advance the web, the advancing stroke of the registering member being such that, at the end of it, a slit arranged downstream from the said slit engaged by the registering member, finds itself exactly on the aforementioned cutting plane. Of course, the above occurs provided that the labels comprised between the slit engaged by the registering member and the slit along which the cutting means would operate are all as they are supposed to be, that is of equal length. As already said, the above might be not true owing to errors during printing; accordingly, in the device subject of U.S. Pat. No. 2,725,101, some of the cut may not coincide exactly with a respective slit. It is true however that, owing to the registering member, any cutting error will not affect the following cutting operations. U.S. Pat. No. 2,885,839 issued May 12, 1959 teaches that if a ribbon provided with spaced registration transverse slits is to be severed by cutting means exactly at said registration slits independently of the distance between successive registration slits, the best way of operation is that of first bringing each said slit into engagement with the cutting means, and then operating the cutting means.

In other words, U.S. Pat. No. 2,885,839 teaches that if a ribbon provided with preformed spaced transverse slits is to be severed into pieces exactly along said slits by a cutting means, the more suitable registering member to be used is the cutting means itself.

A registering cutting means is disclosed in U.S. Pat. No. 3,435,717 issued Apr. 1, 1969 and relating to an apparatus for cutting labels from a continuous ribbon of labels comprising at least one cut between adjacent labels, and for supplying the separate cut labels to a labelling or banding device.

In the above apparatus, registration is accomplished by engaging the ribbon and deform the same so as to open each slit, and define an abutment for an edge of the cutting means so as to sever the ribbon with great accuracy along the slits so that no registration mark remains on the cut labels.

In particular, a preferred embodiment of the invention subject of U.S. Pat. No. 3,435,717 relates to an apparatus in which the ribbon path along which the ribbon is advanced by reciprocating feeding means towards the cutting means is provided, immediately upstream from the cutting means with a centrally located protuberance which urges the central portion of the ribbon away from the ribbon path, whereas the lateral portions of the ribbon are made to advance in contact with the ribbon path by lateral guide means. Said protuberance and guide means cause the ribbon to bow; in particular when a slit leaves said protuberance, its leading edge snaps back into contact with the ribbon path, whereas its trailing edge remains bowed and abuts a lateral side of a knife or movable blade of the cutting means. Positive registration contact between said movable blade and said trailing edge is assured by the feeding means continuing their feeding stroke after the above contact occurs, thus causing the length of the ribbon comprised between said feeding means and the movable blade to buckle longitudinally. Accordingly the movable blade, when operated towards a fixed blade arranged on the other side of the ribbon path, severs the ribbon exactly along the above slit.

The apparatus described in U.S. Pat. No. 3,434,717 is very effective when used to supply with labels or coupons a wrapping device capable of wrapping one or two cigarette packets per second, but is completely unsuited for use with modern wrapping machines capable of wrapping cigarette packets at a normal rate of seven packets per second.

The above will become apparent when considering the operation of the above apparatus at a speed three-four times higher than its normal speed of operation. It is abvious in fact that, since contact between the trailing edge of a split and the movable blade occurs at relatively high speed during the feeding stroke of the feeding means, the shorter the feeding cycle, the higher the speed of movement, the more dangerous the collision between said trailing edge and the movable blade. At a speed three-four times higher than normal, said trailing edge, when abutting the movable blade may either collapse, or bound back.

In either case, the operation of the movable blade may result in the ribbon being severed along a line which does not coincide with the slit.

A further factor which may play a very important role in preventing the exact registration of said trailing edge on said cutting plane consists in that the registering member, that is the movable blade, is moved after registration in contact with said trailing edge and in a direction at right angles to the feeding direction of the ribbon. Since the said trailing edge exerts a pressure on the lateral side of the blade whilst the latter is moved towards the ribbon path, the ribbon may be bent at said trailing edge and thus advance beyond the registered position.

SUMMARY OF THE INVENTION

It is an object of the present invention to provide a feeding and cutting device in which a continuous web with spaced transverse registration slits may be severed into pieces exactly at said slits to obtain separate labels or coupons at a sufficient rate to feed a modern high speed user machine, in particular a wrapping machine capable of wrapping at least seven cigarette packets per second.

According to the invention there is provided a feeding and cutting device in which a continuous web of sheet material provided with spaced transverse central slits is step advanced by feeding means along a web path to cutting means comprising a movable blade and a stationary blade arranged on opposite sides of said web path on a fixed cutting plane substantially at right angles to said web path, said feeding means advancing the web so that, at the end of each advancing step, one slit is located a short distance downstream from said cutting plane; reciprocating pushing means being operable, at the end of each advancing step, in a direction towards said stationary blade and parallel to said cutting plane to engage the web downstream from said one slit so as to depress the leading edge thereof; and return feeding means being operable in a direction opposite to said feeding means and before operation of said movable blade, to displace said web backwards until said depressed leading edge engages a lateral downstream edge of said stationary blade.

BRIEF DESCRIPTION OF THE DRAWINGS

The invention will be described by way of example with reference to the accompanying drawings, in which:

FIG. 3 is an enlarged perspective view of a particular of the device, taken in the direction of arrow F of FIG. 1; and FIG. 4 shows, in the form of graphs plotted relative to a common reference, the motion laws relating to a machine cycle of significant parts of the device in accordance with the invention.

DETAILED DESCRIPTION OF THE DRAWINGS

Figure 1:
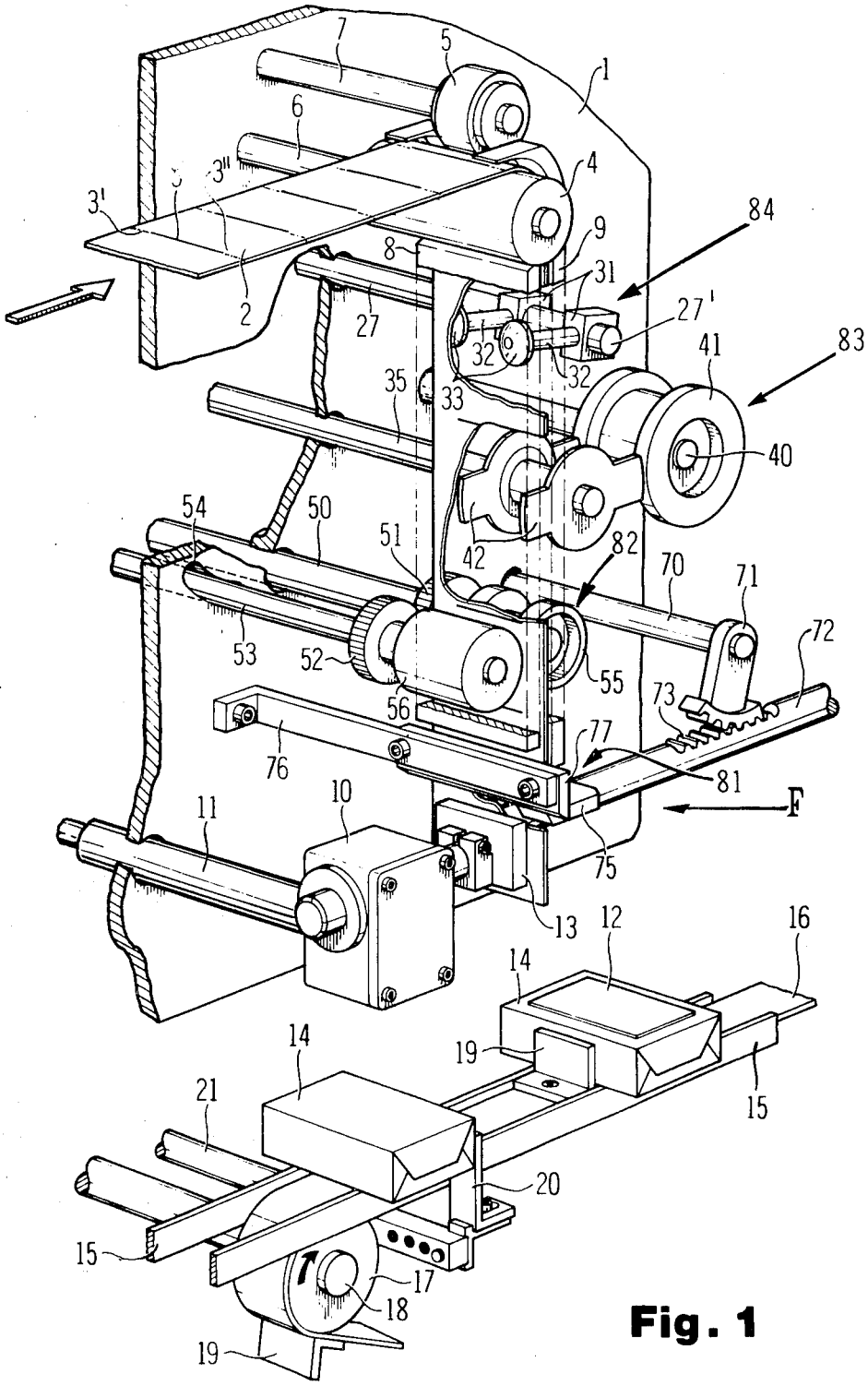
FIG. 1 is a perspective part-sectional view of a feeding and cutting device in accordance with the invention.
Figure 2:
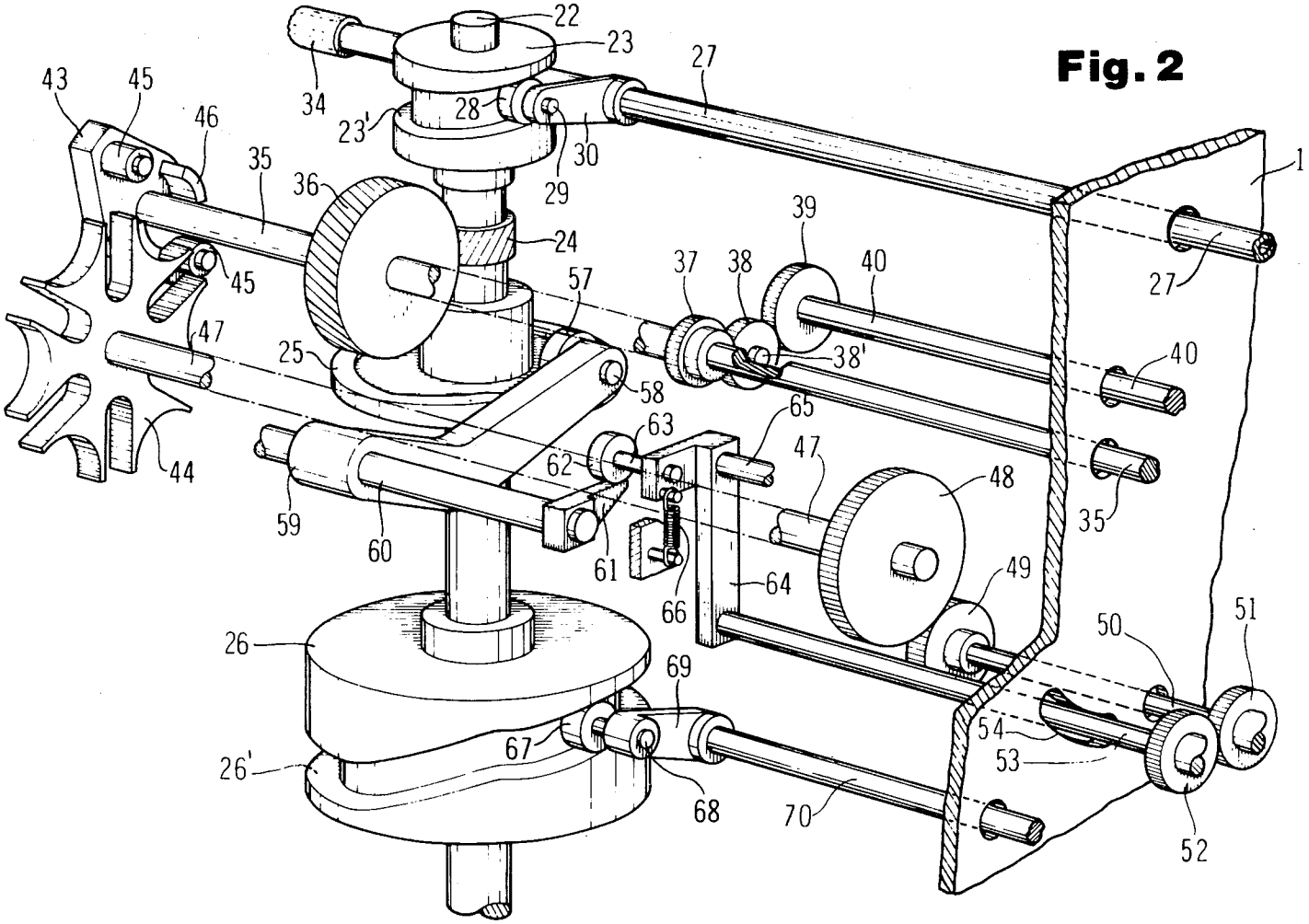
FIG. 2 is a perspective part-sectional view of means for driving the device shown in FIG. 1.

With particular reference to FIGS. 1 and 2, with 1 is indicated a front wall of a known high-speed "cellophane" wrapping machine, hereinafter simply called "wrapping machine", which is capable of wrapping at least seven cigarette packets per second.

With 2 is indicated a continuous web of sheet material, preferably paper, provided with equispaced transverse slits 3 extending through a central portion of web 2, thus leaving two uncut side portions 3' and 3'', shown with dotted lines (see FIGS. 1 and 3), which assure the continuity of web 2. Web 2 is unwound from a spool (not shown) and extends along a web path along which web 2 is guided by two idle rollers 4 and 5 mounted on one end of respective stationary shafts 6 and 7, the other ends of which are secured to wall 1, and by stationary guides 8 and 9 also secured to said wall 1. Slits 3 are spaced apart by a distance corresponding to the length of a coupon or label 12.

The transferring of individual coupons 12 from the aforementioned web path to the cigarette packets is carried out by means of a known device comprising a block member 10 provided with a suction plate member 13 and pivotally mounted on a shaft 11.

Cigarette packets 14 are flatwise fed to a coupons' application station by known conveyor means comprising two coplanar horizontal guides 15, parallel to wall 1 and secured thereto through means not shown. An endless horizontal belt 16, disposed between and under said guides 15, is continuously moved from left to right (viewing FIG. 1) by a clockwise rotating roller 17 keyed on a shaft 18 driven by a motor (not shown) of the wrapping machine.

Practically, endless belt 16 has the task of transferring the cigarette packets 14 to the wrapping means (not shown) of the wrapping machine and is provided with spaced apart brackets 19 adapted to engage a narrow side of cigarette packets 14.

Two blade members 20 (only one is shown in FIG. 1) known per se are keyed on a shaft 21 which is parallel to shaft 11 and is oscillated about its axis. Blade members 20 have the task of temporarily holding the cigarette packets 14 during the coupons' application phase, before the arrival of a bracket 19.

Along the web path, there are provided a web-cutting means 81, a web-feeding means 82, a web-glueing means 83 and a web-adjusting or return means 84, the later means acting, in particular, in combination with said web-cutting and web-feeding means 81 and 82.

Means 81, 82, 83 and 84 are all controlled (see FIG. 2) by a driving shaft 22 contained within the basement of the wrapping machine and driven by the motor of said machine.

On shaft 22 are keyed a drum-cam 23, a toothed wheel 24, a face-cam 25 and a further drum-cam 26.

Dram-cam 23 imparts an oscillation rotational motion to a hollow shaft 27, parallel to shafts 6 and 7, extending through wall 1 underneath said later shafts and on the right (viewing FIG. 1) of the web path. A cam-follower 28 engages a groove 23' of cam 23, cam-follower 28 being mounted on a pin 29 supported by one end of a lever 30, the other end of which is keyed on shaft 27.

One end of hollow shaft 27 (see FIG. 1) is closed by a plug 27', or similar means, while the other end, inside the basement of the wrapping machine (see FIG. 2), is connected to a flexible pipe 34 leading to a suction source (not shown).

As shown in FIG. 1, on the one end of shaft 27 a pair of block members 31 are keyed, each of which is provided with a hollow shaft 32 extending towards web 2 and carrying a sucker 33 communicating with said suction source.

The toothed wheel 24 meshes with a first toothed wheel 36 keyed on a middle portion of a shaft 35, parallel to shaft 27. On shaft 35 is also keyed a second toothed wheel 37 which meshes with an idle toothed wheel 38 supported by a stationary shaft 38'.

Toothed wheel 38 meshes with a toothed wheel 39 keyed on one end (the left one viewing FIG. 2) of a shaft 40, parallel to shaft 35.

On one end (the left one viewing FIG. 2) of shaft 35 there is provided a device 43 comprising two diammetrically opposed rollers 45 and, interposed therebetween, two arcuate sectors or centering members 46 for intermittently driving a six-space Maltese cross 44 keyed on one end (the left one viewing FIG. 2) of a shaft 47, parallel to shaft 35.

Shafts 35 and 40, lying on the same plane, extend through wall 1 on the right (viewing FIG. 1) of the web path. On the other end of shaft 40 there is keyed a glue-distributor roller 41 plunging into a glue container (not shown), while on the other end of shaft 35 there are keyed two parallel glueing disks 42, for transferring the glue from distributor 41 on to web 2.

A toothed wheel 48 is keyed on the other end of shaft 47, and said wheel meshes with a toothed wheel 49 keyed on one end (the left one viewing FIG. 2) of a shaft 50, parallel to shaft 47. Shaft 50 (see FIGS. 1 and 2) extends through wall 1 underneath said glueing means 41 and 42, on the right of the web path, and on the other end of shaft 50 there is keyed a toothed wheel 51 and a first web-feeding roller 55 adapted to cooperate, as it will be described hereinafter, with a second web-feeding roller 56.

Face-cam 25 is engaged by a cam-follower 57 supported by a pin 58 secured to one end of a lever 59, the other end of which is keyed on a shaft 60 parallel to shaft 35 and provided with a bracket member 61.

Bracket member 61 cooperates with an idle roller 62 supported by a pin 63 carried by one arm of a rocker 64 fulcrumed on a pin 65, parallel to the shaft 60 and supported, by means not shown, by the basement of the wrapping machine. On the other arm of rocker 64 one end of a shaft 53 is secured, said shaft 53 passing through an arcuate slot 54 on wall 1 and carrying on the other end a toothed wheel 52, which is adapted to mesh, with a ratio 1:1, with the toothed wheel 51. A spring 66 engages with one end said first arm of member 64, and the other end of said spring 66 is hooked on a pin integral with the frame of the wrapping machine.

Drum-cam 26 controls, through its groove 26', a cam-follower 67 carried by a pin 68 supported by one end of a lever member 69, the other end of which is keyed on one end of a shaft 70, parallel to shafts 50, 53 and passing through wall 1 on the right of the web path. On the other free end of shaft 70 a toothed sector 71 is keyed which meshes with a rack 73 provided on a hollow shaft 72 extending at right angles to shaft 70 and lying at a level just above suction plate member 13. With particular reference to FIG. 3, and also as shown in FIG. 1, the free end of shaft 72 carries a fork-shaped movable blade 74 arranged at right angles to the web path and provided with two arms 75, which are directed towards the web path and are each provided with a cutting sharp edge 75'. As shown in FIG. 3, edges 75' are spaced apart by a distance equal to the length of slits 3 so as to be able to sever the uncut side portions 3' and 3'' of web 2.

On the left of the web path, secured to wall 1 transversely of shaft 72, there is provided a bracket 76 carrying a stationary blade 77, a lower cutting edge 77' of which is positioned adjacent said web path and is substantially co-planar with cutting edges 75' of blade 74.

Within hollow shaft 72 is slidingly mounted a shaft 78, counteracted on one end by a spring 79 and carrying on the other end, protruding from shaft 72, an elongated pushing member 80 facing web 2 and extending parallel thereto. Member 80 is positioned centrally relative to cutting edges 75', and has a front surface in a face to face relationship with web 2, said front surface being arranged, at rest, between said web path and cutting edges 75'.

The operation of the feeding and cutting device will be described starting from a moment of the feeding and cutting cycle in which, after having cut one coupon from web 2 and delivered said cut coupon to the application station by means of members 10 and 13, the device starts feeding a new coupon to cutting means 81, that is stationary blade 77 and movable blade 74.

At the start, the leading edge of web 2 coincides exactly with the cutting edge 77' of stationary blade 77, rollers 55 and 56 are positioned so as to clamp web 2 therebetween with such a pressure to be capable of advancing web 2 when rotated, and hollow shaft 27 is arranged so that suckers 33 find themselves in their rearmost position.

The starting position described above corresponds substantially to the 180° position in FIG. 5.

Upon rotation of shaft 22 driven by the motor (not shown) of the wrapping machine, the web-feeding means 82, that is rollers 55 and 56 and kinematik chain 24, 35, 36, 43, 44, 47, 48, 49, cause web 2 to advance one step. Web-feeding means 82 are designed so that, at any step, a length of web 2 is advanced which exceeds by a fraction of an inch the distance between adjacent slits 3. Accordingly, at the end of each advancing step, a slit 3 is located a short distance downstream from cutting edge 77' of stationary blade 77. During each advancing step, a proper amount of glue is transferred by glueing disks 42 on to web 2, disks 42 providing web 2 with two parallel lateral tracks of glue extending between adjacent uncut portions 3' and 3'' respectively. At the end of each advancing step, a coupon 12 to be cut is arranged in contact with suction plate member 13, which is disposed in its pick-up position shown in FIG. 1 and forms an extension of the web path downstream from stationary blade 77. When in its pick-up position, suction plate member 13 is arranged with its upstream edge a short distance downstream from cutting edge 77', thus defining a gap through which pushing member 80 and arms 75 may extend.

As shown in FIG. 4, a short time before each advancing step ends, shaft 22 operates toothed sector 71 via shaft 70, drum-cam 26 and lever 69, thus causing shaft 72 to advance a predetermined distance towards the web path, and pushing member 80 to abut the surface of coupon 12 which has been advanced past cutting edge 77'.

Owing to coupon 12 to be cut being kept aligned with the web path by suction through suction plate member 13, and the adjacent coupon being supported by stationary blade 77 against the action of pushing member 80, contact between member 80 and coupon 12 to be cut causes a central portion of the latter, arranged at the gap between stationary blade 77 and suction plate member 13 and downstream from slit 3, to buckle, and thus the leading edge of slit 3 to be depressed without substantially deforming the trailing edge thereof. Said leading edge, when depressed, extends through the web path and beyond cutting edge 77'.

Short before the end of the advancing step, rocker 64 is caused to rotate against the action of spring 66 by cam follower 57 engaging a protruding portion of face-cam 25, which is driven by the motor (not shown) of the wrapping machine via shaft 22. Such a rotation of rocker 64 causes shaft 53, and thus roller 56, to be displaced transversely along arcuate slot 54 and away from shaft 50 and roller 55 respectively, thus disconnecting web 2 from feeding means 82, that is from rollers 55 and 56.

Short before operation of rocker 64 against the action of spring 66, hollow shaft 27 is rotated by shaft 22 via cam 23 and lever 30 to displace suckers 33 towards rollers 4 and 5 in a direction opposite to the feeding direction. During this movement, which will be referred to as "return" or "registering stroke" of return means 84, that is of suckers 33 and shafts 27 and 32, suckers 33 are in communication with the aforementioned suction source (not shown) connected to shaft 27, and engage web 2. The latter, being free from rollers 55 and 56, is displaced backwards by suckers 33 until the depressed leading edge of slit 3 arranged downstream from stationary blade 77 abuts cutting edge 77'.

A further advancement of shaft 72 then occurs which causes arms 75 to move on a cutting plane substantially at right angles to the web path and extending through the latter, and sharp edges 75' to co-operate with cutting edge 77' to sever side portions 3' and 3'' along cuts exactly aligned with slit 3. Shaft 72 is then returned to its rest position, thus allowing member 13 to remove cut coupon 12 and transfer the same to the aforementioned application position.

As far as shaft 72 is concerned, it is to be pointed out that during a first portion of its operative or direct movement towards the web path, spring 79 remains substantially unaffected, whereas during the aforementioned further portion of the operative movement of shaft 72, spring 79 is compressed owing to pushing member 80 being prevented from advancing by its abuting web 2. Of course, spring 79 is choosen so as to get deformed before web 2 is broken by pushing member 80.

As far as return means 84 are concerned, flexible pipe 34 may or may not be connected to the suction source (not shown) by means of a distributor (not shown) designed so as to allow communication between suckers 33 and said suction source during the registering stroke of return means 84 only. In case the above distributor is not used, and suckers 33 always communicate with said suction source, return means 84 act as a brake means during a last portion of each advancing step of web 2. This is due to the fact that the length of the stroke of suckers 33 is only a fraction of the length by which web 2 is advanced at any step by web-advancing means 82.

The feeding and cutting device described hereinabove is particularly suited for feeding coupons or labels to high speed wrapping machines capable of wrapping at least seven cigarette packets per second, and in which a coupon or label is to be applied to each individual packet.

The above is due to many features of the above device, one of said features consisting in that, at the end of each advancing step, web 2 does not collide with any registering member. In other words, registration of a slit 3 on the cutting plane, that is the plane on which the cutting means operate, does not occur during a last portion of each advancing step; accordingly, web 2 may be advanced at any speed without any danger of an edge of said slit being deformed by its abutting a fixed registering member.

Though the means for advancng the web may be different from those of the preferred embodiment described hereinabove, it is to be pointed out that advancing means 82 are particularly suitable to advance web 2 at a very high speed owing to the fact that they are not reciprocating means and, accordingly, they do not have to brake down at the end of each advancing step, stoppage of web 2 being obtained by simply disengaging advancing means 82 from web 2 with rollers 55 and 56 still rotating at substantially full speed. As far as registration is concerned, it is to be pointed out that the backward movement by which the leading edge of slit 3 is brought into contact with the registering member may be very short when compared to the length of the advancing step. Accordingly, the backward displacement may take a very short time to be carried out also if it occurs at a relatively low speed, that is at a speed low enough to avoid any deformation or bounce of the leading edge when abutting the registration member.

A very important feature which is to be pointed out is that the above backward displacement is due to web 2 being drawn back and not pushed back. In other words, the backward displacement is not caused by any movable member engaging the slit to be registered and displacing the same back to the cutting plane, but simply by engaging web 2 at a position upstream from the cutting plane and by drawing web 2 backwards. No pushing means is therefore used which, by engaging the slit to be registered and pushing it back to the cutting plane, maight deform the edges of said slit.

Though other return or registering means may be substituted for those used in the preferred embodiment described hereinabove, it is to be pointed out that suckers 33 are particularly suited for registration purposes. It is in fact to be noted that as soon as the leading edge of slit 3 to be registered abuts the registering member, suckers 33 start sliding along web 2, thus applying thereto a static pulling force which assures a constant and positive contact between said leading edge and the registering member.

A further important feature to be pointed out is that the registering member is fixed relative to the web path, and that, after contact with said leading edge, no relative movement between the latter and the registering member occurs; accordingly, no possibility arises of said leading edge being bent during cutting.

In the preferred embodiment described hereinabove, stationary blade 77 is used as registering member; however, it is understood that any other fixed member arranged on the cutting plane and capable of engaging said depressed leading edge may be substituted for stationary blade 77. In particular, stationary blade 77 may be replaced by two fixed blade portions (not shown) adapted to co-operate with arms 75, and between which a separate fixed central registering member (not shown) is arranged to engage said depressed leading edge of slit 3.

In the preferred embodiment described hereinabove, the device of the invention co-operates with a known transfer device, namely transfer device 10, 11, 13; it is however understood that this device, which as well as the wrapping machine and its conveyor 15, 16, 17, 18, 19, 20, forms no part of the invention, may be replaced by any other suitable transfer device. In case a transfer device is used which does not comprise any means to support and hold the coupon to be cut, a support and holding plate (not shown) or the like is to be preferably fixed to wall 1 downstream from stationary blade 77 and at a distance therefrom to allow pushing member 80 and movable blade 74 to operate.

What I claim is:

1. A feeding and cutting device for sheet material in the form of a continuous web to be cut into pieces at substantially equispaced transverse slits provided centrally through the web, the device comprising a web path for said web; cutting means associated with said web path and arranged transversely thereto, said cutting means comprising a cutting movable on a cutting plane through said web path; web feeding means to feed the web to said cutting means in a step-by-step manner; a fixed registering member arranged on said cutting plane on one side of the web path; reciprocating pushing means arranged on the other side of the web path and operable towards the latter to depress the leading edge of one said slit arranged downstream from said cutting plane; and return means to engage the web upstream from said cutting plane and draw the web backwards until said depressed leading edge abuts said registering member at said cutting plane, said return means comprise sucker means reciprocating along said web path while remaining substantially stationary in a direction transversely of the web path and substantially continuously engaging said web at a position upstream from said cutting plane and at least during their movement away from said cutting plane.

2. A device as claimed in claim 1, wherein said return means comprise a plurality of suckers connectable to a suction source and arranged adjacent said web path upstream from said cutting plane; and reciprocating support means for said suckers to displace the latter along said web path to and for said cutting means; said suckers communicating with said suction source at least during their movement away from said cutting means, and said reciprocating support means and said drive means being co-ordinated in timed relationship so that said movement of the suckers away from the cutting means starts before movement of the rollers to said second position.

3. A feeding and cutting device for sheet material in the form of a continuous web to be cut into pieces at substantially equispaced transverse slits provided centrally through the web, the device comprising a web path for said web; cutting means associated with said web path and arranged transversely thereto, said cutting means comprising a cutting member movable on a cutting plane through said web path; web feeding means to feed the web to said cutting means in a step-by-step manner; a fixed registering member arranged on said cutting plane on one side of the web path; reciprocating pushing means arranged on the other side of the web path and operable towards the latter to depress the leading edge of one said slit arranged downstream from said cutting plane; and return means to engage the web upstream from said cutting plane and draw the web backwards until said depressed leading edge abuts said registering member at said cutting plane, said pushing means are supported by said movable cutting member for movement therewith; resilient means arranged parallel to the direction of this movement being provided to allow relative movement between said pushing means and said movable cutting member.

* * * * *